US005658874A

United States Patent [19]

Davies et al.

[11] Patent Number: 5,658,874

[45] Date of Patent: Aug. 19, 1997

[54] PRODUCTION OF DETERGENT TABLET COMPOSITIONS

[75] Inventors: Alan Phillip Davies, Wirral; Sara Jane Edwards, Cheshire; Pauline Farnworth, Wirral; Douglas Wraige, Chester, all of United Kingdom

[73] Assignee: Lever Brothers Company, Division of Conopco, Inc., New York, N.Y.

[21] Appl. No.: 557,976

[22] Filed: Nov. 13, 1995

[30] Foreign Application Priority Data

Nov. 14, 1994 [GB] United Kingdom ..... 9422925

[51] Int. Cl.[6] ..... C11D 11/00

[52] U.S. Cl. ..... 510/446; 510/294; 510/298; 510/441; 510/475; 510/507

[58] Field of Search ..... 510/446, 294, 510/298, 441, 475, 507

[56] References Cited

U.S. PATENT DOCUMENTS

| | | | |
|---|---|---|---|
| 3,081,267 | 3/1963 | Laskey | 252/135 |
| 3,231,505 | 1/1966 | Farrar et al. | 252/138 |
| 3,366,570 | 1/1968 | Slob | 292/99 |
| 3,951,821 | 4/1976 | Davidson | 252/1 |
| 3,953,350 | 4/1976 | Fujino et al. | 252/94 |
| 3,962,107 | 6/1976 | Levin et al. | 252/100 |
| 4,370,250 | 1/1983 | Joshi | 252/135 |
| 4,587,031 | 5/1986 | Kruse et al. | 252/135 |
| 4,642,197 | 2/1987 | Kruse et al. | 252/98 |
| 4,839,078 | 6/1989 | Kruse et al. | 252/99 |
| 4,996,006 | 2/1991 | Constantine et al. | 252/550 |
| 5,225,100 | 7/1993 | Fry et al. | 252/174.25 |
| 5,360,567 | 11/1994 | Fry et al. | 252/90 |
| 5,382,377 | 1/1995 | Raehse et al. | 252/174 |
| 5,407,594 | 4/1995 | Fry et al. | 252/90 |

FOREIGN PATENT DOCUMENTS

| | | | |
|---|---|---|---|
| 0130639 | 9/1987 | European Pat. Off. . | |
| 0318204 | 5/1989 | European Pat. Off. . | |
| 0375022 | 6/1990 | European Pat. Off. . | |
| 0395333 | 10/1990 | European Pat. Off. . | |
| 0466484 | 1/1992 | European Pat. Off. . | |
| 0466485 | 1/1992 | European Pat. Off. . | |
| 481793 | 4/1992 | European Pat. Off. . | |
| 0482627 | 4/1992 | European Pat. Off. . | |
| 0508934 | 10/1992 | European Pat. Off. . | |
| 0522766 | 1/1993 | European Pat. Off. . | |
| 1290282 | 3/1969 | Germany . | |
| 58-213714 | 12/1983 | Japan . | |
| 911204 | 11/1962 | United Kingdom . | |
| 972239 | 10/1964 | United Kingdom . | |
| 983243 | 2/1965 | United Kingdom . | |
| 989683 | 4/1965 | United Kingdom . | |
| 1080066 | 8/1967 | United Kingdom . | |
| 2021143 | 11/1979 | United Kingdom | 252/174.17 |
| WO90/02165 | 3/1990 | WIPO . | |

OTHER PUBLICATIONS

Abstract of JP 60–015500.

Abstract of JP 60–135497.

Abstract of JP 60–135498.

Lowenthal, W. et al., "Disintegration of Tablets", *Journal of Pharmaceutical Sciences*, vol. 61, No. 11, Nov. 1972, pp. 1695–1711.

*Primary Examiner*—Paul Lieberman
*Assistant Examiner*—Lorna M. Douyon
*Attorney, Agent, or Firm*—Rimma Mitelman

[57] ABSTRACT

Detergent tablets, compacted from detergent powder containing detergent active and detergency builder, contain a polymer which acts as binder and as a disintegrant when the tablets are added to water. Preferably the binder is sprayed into the powder before compaction. The strength of such tablets is improved, without detriment to other properties, by tabletting at a temperature above ambient but below melting point of the polymeric binder. Preferably the temperature is only 5° C. to 10° C. below the melting point of the binder.

8 Claims, No Drawings

PRODUCTION OF DETERGENT TABLET COMPOSITIONS

FIELD OF THE INVENTION

The present invention relates to detergent compositions in the form of tablets of compacted detergent powder.

BACKGROUND AND PRIOR ART

Detergent compositions in tablet form are known in the art, as discussed below, and some products are now on the market. Tablets have several advantages over powdered products: they do not require measuring and are thus easier to handle and dispense into the washload, and they are more compact, hence facilitating more economical storage.

Detergent tablets are described, for example, in GB 911204 (Unilever), U.S. Pat. No. 3,953,350 (Kao), JP 60-015500A (Lion), JP 60-135497A (Lion) and JP 60-135498A (Lion); and are sold commercially in Spain.

Detergent tablets are generally made by compressing or compacting a detergent powder.

As pointed out in EP-A-522766 (Unilever), difficulty has been encountered in providing tablets which have adequate strength when dry, yet dispense and dissolve quickly when wet.

EP-A-522766 discloses tablets of compacted particulate detergent composition in which at least some particles of the composition are individually coated with a material which functions as a binder but also functions as a disintegrant capable, when the tablet is immersed in water, of disrupting the structure of the tablet. At least some of the binder/disintegrant materials disclosed are able to melt at temperatures which are above ambient but below 90° C.

SUMMARY OF THE INVENTION

We have now found that a surprising improvement in tablet properties can be achieved by compacting such a coated powder at a temperature which is above ambient, preferably so as to lie within a narrow temperature band just below the melting temperature of the binder material.

Accordingly, this invention provides a process for making tablets of a detergent composition comprising detergent active compound, detergency builder and optionally other detergent ingredients, by compacting a particulate detergent composition distributed within which is a binder material having a melting temperature in a range from 35° C. to 90° C., characterised by compacting the particulate composition into tablets at a temperature which is at least 28° C. and/or above ambient temperature but is below the melting temperature.

DETAILED DESCRIPTION AND EMBODIMENTS

As mentioned, the temperature at which the powder is compacted should be above ambient temperature. A compaction temperature of at least 28° C. will generally be above ambient temperature in many climates.

The melting temperature of the binder material preferably lies in a range from 35° or 40° C. to 70° C. The temperature of compaction is preferably at least 5° C. below the melting temperature of the binder material. Preferably it is not more than 15° C. below this temperature.

Preferred is that the temperature of compaction is at least 30°, better at least 35° C. and that the melting temperature of the binder material is not more than 60° C., although higher melting binders can be used.

Raising the temperature of tabletting above ambient allows adequate strength to be achieved with less compaction pressure. Advantageous in itself, this generally leads to tablets which are more porous and disintegrate more quickly.

Particle Size and Distribution

A detergent tablet produced by the method of this invention, or a discrete region of such a tablet, is a matrix of compacted particles.

Preferably the particulate composition which is compacted is substantially free of small particles.

More preferably, the composition consists substantially wholly of particles within the size range of 180 to 2000 μm, desirably at least 200 μm and still more preferably from 250 to 1400 μm. It is desirable that not more than 5 wt % of particles should be larger than the upper limit, and not more than 5 wt % should be smaller than the lower limit.

This distribution is different from that of a conventional spray-dried detergent powder. Although the average particle size of such a powder is typically about 300–500 μm, the particle size distribution will include a "fines" (particles <180 or 200 μm) content of 10–30 wt %.

Such a powder may nevertheless be a suitable starting material for a tablet according to the present invention, if the fines are eliminated first by sieving.

While the starting particulate composition may in principle have any bulk density, the present invention is especially relevant to tablets made by compacting powders of relatively high bulk density, because of their greater tendency to exhibit disintegration and dispersion problems. Such tablets have the advantage that, as compared with a tablet derived from a low-bulk-density powder, a given dose of detergent composition can be presented as a smaller tablet.

Thus the starting particulate composition may suitably have a bulk density of at least 400 g/litre, preferably at least 500 g/litre, and advantageously at least 700 g/litre.

Granular detergent compositions of high bulk density prepared by granulation and densification in a high-speed mixer/granulator, as described and claimed in EP 340013A (Unilever), EP 352135A (Unilever), and EP 425277A (Unilever), or by the continuous granulation/densification processes described and claimed in EP 367339A (Unilever) and EP 390251A (Unilever), are inherently suitable for use in the present invention.

Most preferred are granular detergent compositions prepared by granulation and densification in a high-speed mixer/granulator (Fukae mixer), as described in the above-mentioned EP 340013A (Unilever) and EP 425277A (Unilever). With some compositions, this process can produce granular compositions satisfying the criteria of particle size distribution given above, without sieving or other further treatment.

The tablet of the invention may be either homogeneous or heterogeneous. In the present specification, the term "homogeneous" is used to mean a tablet produced by compaction of a single particulate composition, but does not imply that all the particles of that composition will necessarily be of identical composition. The term "heterogeneous" is used to mean a tablet consisting of a plurality of discrete regions for example having layers, inserts or coatings around inserts derived by compaction from a particulate composition.

In a heterogeneous tablet, any one or more of the discrete regions may consist essentially of a matrix as defined above. Where two or more such matrices are present in different regions, they may have the same or different particle size ranges: for example, a first region (for example, outer layer) may consist essentially of particles with a relatively wide particle size range (for example, 250 to 1400 μm) while another (inner core) may consist essentially of particles with a relatively narrow particle range (for example, 500 to 710 μm).

It is within the scope of the invention, for a minor proportion of visually contrasting particles not within the size range of the matrix to be present: the most obvious example of this being the inclusion of a small proportion of much larger particles. In this embodiment of the invention, the visually contrasting particles must be larger in at least one dimension than the matrix particles. The effect of contrast may be enhanced if the non-matrix particles are of a contrasting shape, for example, noodles. Visual contrast may if desire be further emphasised by the use of a contrasting colour.

As previously indicated, it is not necessary for all the particles constituting the matrix to be of identical composition. The particulate starting composition may be a mixture of different components, for example, a spray-dried detergent base powder, surfactant particles, additional builder salts, bleach ingredients and enzyme granules, provided that all satisfy the criteria on particle size.

Binder

The particulate composition must include a binder material. Preferred is that at least some of the particles of the detergent composition are individually coated with the binder material. Then, when the composition is compacted, this coating serves as a binder distributed within the composition.

It is strongly preferred that the binder is water-soluble and that it serves as a disintegrant by disrupting the structure of the tablet when the tablet is immersed in water, as taught in our EP-A-522766.

The binder material should melt at a temperature of 35° C., better 40° C. or above, which is above ambient temperatures in many temperate countries. For use in hotter countries it will be preferable that the melting temperature is somewhat above 40° C., so as to be above the ambient temperature.

For convenience the melting temperature of the binder material should be below 80° C.

Preferred binder materials are synthetic organic polymers of appropriate melting temperature, especially polyethylene glycol. Polyethylene glycol of average molecular weight 1500 (PEG 1500) melts at 45° C. and has proved suitable. Polyethylene glycols of molecular weight 4000 and 6000 melt at about 55° C. and 62° C. respectively.

Other possibilities are polyvinylpyrrolidone, and polyacrylates and water-soluble acrylate copolymers.

The binder may suitably be applied to the particles by spraying, e.g. as a solution or dispersion. The binder is preferably used in an amount within the range from 0.1 to 10% by weight of the tablet composition, more preferably at least 1%, better at least 3%. It is preferred that the amount is not more than 8% or even 6%.

Detergent-Active Compounds

The total amount of detergent-active material in the tablet of the invention is suitably from 2 to 50 wt %, and is preferably from 5 or 9% up to 40 wt %. Detergent-active material present may be anionic (soap or non-soap), cationic, zwitterionic, amphoteric, nonionic or any combination of these.

Anionic detergent-active compounds may be present in an amount of from 0.5 to 40 wt % possibly from 2 or 4 wt % upwards. The amount may well be no more than 30 wt %.

Synthetic (i.e. non-soap) anionic surfactants are well known to those skilled in the art. Examples include alkylbenzene sulphonates, particularly sodium linear alkylbenzene sulphonates having an alkyl chain length of $C_8$–$C_{15}$ primary alcohol sulphate; olefin sulphonates; alkane sulphonates; dialkyl sulphosuccinates; and fatty acid ester sulphonates.

Primary alkyl sulphate having the formula $$ROSO_3^-M^+$$

in which R is ah alkyl or alkenyl chain of 8 to 18 carbon atoms, especially 10 to 14 carbon atoms and $M^+$ is a solubilising cation is commercially significant as an anionic detergent active. It is frequently the desired anionic detergent and may provide 75 to 100% of any anionic non-soap detergent in the composition.

In some forms of this invention the amount of non-soap anionic detergent lies in a range from 0.5 to 15 wt % of the tablet composition.

It may also be desirable to include one of more soaps of fatty acids. These are preferably sodium soaps derived from naturally occurring fatty acids, for example, the fatty acids from coconut oil, beef tallow, sunflower or hardened rapeseed oil.

Suitable nonionic detergent compounds which may be used include in particular the reaction products of compounds having a hydrophobic group and a reactive hydrogen atom, for example, aliphatic alcohols, acids, amides or alkyl phenols with alkylene oxides, especially ethylene oxide ether alone or with propylene oxide.

Specific nonionic detergent compounds are alkyl ($C_{8-22}$) phenol-ethylene oxide condensates, the condensation products of linear or branched aliphatic $C_{8-20}$ primary or secondary alcohols with ethylene oxide, and products made by condensation of ethylene oxide with the reaction products of propylene oxide and ethylene-diamine. Other so-called nonionic detergent compounds include long-chain amine oxides, tertiary phosphine oxides, and dialkyl sulphoxides.

Especially preferred are the primary and secondary alcohol ethoxylates, especially the $C_{12-15}$ primary and secondary alcohols ethoxylated with an average of from 5 to 20 moles of ethylene oxide per mole of alcohol.

In certain forms of this invention the amount of non-ionic detergent lies in a range from 4 to 40%, better 4 or 5 to 30% by weight of the composition.

The nonionic detergent-active compounds may be concentrated in discrete domains. Since the nonionic detergent compounds are generally liquids, these domains are preferably formed from a porous solid carrier impregnated by nonionic detergent-active compound. Preferred carriers include zeolite, sodium perborate monohydrate and Burkeite (spray-dried sodium carbonate and sodium sulphate as disclosed in EP 221776 (Unilever)).

Nonionic detergent-active compounds may optionally be mixed with materials which make such granules slow wetting and/or prevent the nonionic leaching out into the main tablet matrix. Such materials may suitably be fatty acids, especially lauric acid.

The present invention may be applied with compositions which contain more nonionic detergent than non-soap anionic detergent (if any). In compositions of such character, we have found that a weight ratio of nonionic detergent to non-soap anionic detergent in the range 95:5 to 80:20 has been found to give faster dissolution of tablets than does a mixture with a greater proportion of the anionic detergent.

Detergents Builders

The detergent tablets of the invention contain one or more detergency builders, suitably in an amount of from 5 to 80 wt %, preferably from 20 to 80 wt %.

The invention is of especial relevance to tablets derived from detergent compositions containing alkali metal aluminosilicates as builders, since such tablets appear to have a particular tendency to exhibit disintegration and dispersion problems.

Alkali metal (preferably sodium) aluminosilicates may suitably be incorporated in amounts of from 5 to 60% by weight (anhydrous basis) of the composition, and may be either crystalline or amorphous of mixtures thereof, having the general formula:

$$0.8\text{–}1.5Na_2O.Al_2O_3.0.8\text{–}6\ SiO_2$$

These materials contain some bound water and are required to have a calcium ion exchange capacity of at least 50 mg CaO/g. The preferred sodium aluminosilicates contain 1.5–3.5 $SiO_2$ units (in the formula above). Both the amorphous and the crystalline materials can be prepared readily by reaction between sodium silicate and sodium aluminate, as amply described in the literature.

Suitable crystalline sodium aluminosilicate ion-exchange detergency builders are described, for example, in GB 11429143 (Procter & Gamble). The preferred sodium aluminosilicates of this type are the well known commercially available zeolites A and X, and mixtures thereof. Also of interest is the novel zeolite P described and claimed in EP 384070 (Unilever).

Other builders may also be included in the detergent tablet of the invention if necessary or desired. Water-soluble builders may be organic or inorganic. Inorganic builders that may be present include alkali metal (generally sodium) carbonate; while organic builders include polycarboxylate polymers, such as polyacrylates, acrylic/maleic copolymers, and acrylic phosphonates, monomeric polycarboxylates such as citrates, gluconates, oxydisuccinates, glycerol mono- di- and trisuccinates, carboxymethyloxysuccinates, carboxymethyloxymalonates, dipicolinates, hydroxyethyliminodiacetates; and organic precipitant builders such as alkyl- and alkenylmalonates and succinates, and sulphonated fatty acid salts.

Especially preferred supplementary builders are polycarboxylate polymers, more especially polyacrylates and acrylic/maleic copolymers, suitably used in amounts of from 0.5 to 15 wt %, especially from 1 to 10 wt %; and monomeric polycarboxylates, more especially citric acid and its salts, suitably used in amounts of from 3 to 20 wt %, more preferably from 5 to 15 wt %.

Preferred tabletted compositions of the invention preferably do not contain more than 5 wt % of inorganic phosphate builders, and are desirably substantially free of phosphate builders. However, phosphate-built tabletted compositions are also within the scope of the invention.

Other Ingredients of Tablet Composition

Preferred tabletted detergent compositions according to the invention suitably contain alkaline material, e.g. 10–20 wt % sodium carbonate, in order to achieve a desired pH of greater than 9.

Tabletted detergent compositions according to the invention may also contain a bleach system. This preferably comprises one or more peroxy bleach compounds, for example, inorganic persalts or organic peroxyacids, which may be employed in conjunction with activators to improve bleaching action at low wash temperatures. If any peroxygen compound is present, the amount is likely to lie in a range from 10 to 25% by weight of the composition.

Preferred inorganic persalts are sodium perborate monohydrate and tetrahydrate, and sodium percarbonate, advantageously employed together with an activator. Bleach activators, also referred to as bleach precursors, have been widely disclosed in the art. Preferred examples include peracetic acid precursors, for example, tetraacetylethylene diamine (TAED), now in widespread commercial use in conjunction with sodium perborate; and perbenzoic acid precursors. The quaternary ammonium and phosphonium bleach activators disclosed in U.S. Pat. No. 4,751,015 and U.S. Pat. No. 4,818,426 (Lever Brothers Company) are also of interest. Another type of bleach activator which may be used, but which is not a bleach precursor, is a transition metal catalyst as disclosed in EP-A-458397, EP-A-458398 and EP-A-549272. The bleach system may also include a bleach stabiliser (heavy metal sequestrant) such as ethylenediamine tetramethylene phosphonate and diethylenetriamine pentamethylene phosphonate.

The detergent tablets of the invention may also contain one of the detergency enzymes well known in the art for their ability to degrade and aid in the removal of various soils and stains. Suitable enzymes include the various proteases, cellulases, lipases, amylases, and mixtures thereof, which are designed to remove a variety of soils and stains from fabrics. Examples of suitable proteases are Maxatase (Trade Mark), as supplied by Gist-Brocades N.V., Delft, Holland, and Alcalase (Trade Mark), and Savinase (Trade Mark), as supplied by Novo industri A/S, Copenhagen, Denmark. Detergency enzymes are commonly employed in the form of granules or marumes, optionally with a protective coating, in amount of from about 0.1% to about 3.0% by weight of the composition; and these granules or marumes present no problems with respect to compaction to form a tablet.

The detergent tablets of the invention may also contain a fluorescer (optical brightener), for example, Tinopal (Trade Mark) DMS or Tinopal CBS available from Ciba-Geigy AG, Basel, Switzerland Tinopal DMS is disodium 4,4'-bis-(2-morpholino-4-anilino-s-triazin-6-ylamino)stilbene disulphonate; and Tinopal CBS is disodium 2,2'-bis-(phenylstyryl) disulphonate.

An antifoam material is advantageously included in the detergent tablet of the invention, especially if the tablet is primarily intended for use in front-loading drum-type automatic washing machines. Suitable antifoam materials are usually in granular form, such as those described in EP 266863A (Unilever). Such antifoam granules typically comprise a mixture of silicone oil, petroleum jelly, hydrophobic silica and alkyl phosphate as antifoam active material, sorbed onto a porous absorbed water-soluble carbonate-based inorganic carrier material. Antifoam granules may be present in an amount up to 5% by weight of the composition.

In the detergent tablet of the invention, an amount of an alkali metal silicate, particularly sodium ortho-, meta- or preferably alkali metal silicates at levels, for example, of 0.1 to 10 wt %, may be advantageous in providing protection against the corrosion of metal parts in washing machines, besides providing some measure of building.

Effervescent disintegrants may be incorporated in the tablet composition. This category of materials includes weak acids or acid salts, for example, citric acid, maleic acid or tartaric acid, in combination with alkali metal carbonate or bicarbonates; these may suitably be used in an amount of from 1 to 25 wt %, preferably from 5 to 15 wt %. Further examples of acid and carbonate sources and other effervescent systems may be found in Pharmaceutical Dosage Forms: Tablets, Volume 1, 1989, pages 287–291 (Marcel Dekker Inc. ISBN 0-8247-8044-2).

Further ingredients which can optionally be employed in the detergent tablet of the invention include antiredeposition agents such as sodium carboxymethylcellulose, straight-chain polyvinyl pyrrolidone and the cellulose ethers such as methyl cellulose and ethyl hydroxyethyl cellulose, fabric-softening agents; heavy metal sequestrants such as EDTA; perfumes; pigments, colorants or coloured speckles; and inorganic salts such as sodium and magnesium sulphate. Sodium sulphate may if desired be present as a filler material in amounts up to 40% by weight of the composition; however as little as 10% or less by weight of the composition of sodium sulphate, or even none at all, may be present.

As well as the functional detergent ingredients listed above, there may be present various ingredients specifically to aid tabletting. Binders and disintegrants have already been mentioned. Tablet lubricants include calcium, magnesium and zinc soaps (especially stearates), talc, glyceryl behapate, Myvatex (Trade Mark) TL ex Eastman Kodak, sodium benzoate, sodium acetate, polyethylene glycols, and colloidal silicas (for example, Alusil (Trade Mark) ex Crosfield Chemicals Ltd).

Product Character

The detergent tablet of the invention may be, and preferably is, formulated for use as a complete heavy-duty fabric washing composition. The consumer then does not need to use a mix of tablets having different compositions.

Although one tablet may contain sufficient of every component to provide the correct amount required for an average washload, it is convenient if each tablet contains a submultiple quantity of the composition required for average washing conditions, so that the consumer may vary the dosage according to the size and nature of the washload. For example, tablet sizes may be chosen such that two tablets are sufficient for an average washload; one or more further tablets may be added if the washload is particularly large of soiled; and one only tablet may be used if the load is small or only lightly soiled.

Alternatively, larger subdivisible tablets representing a single or multiple dose may be provided with scorings or indentations to indicate unit dose or submultiple unit dose size to the consumer and to provide a weak point to assist the consumer in breaking the tablet is appropriate.

The size of the tablet will suitably range from 10 to 160 g, preferably from 15 to 60 g, depending on the conditions of intended use, and whether it represents a dose for an average wash load, or a submultiple of such a dose.

The tablets may be of any shape. However, for ease of packaging they are preferably blocks of substantially uniform cross-section, such as cylinders or cuboids.

Tabletting

Tabletting entails compaction of a particulate composition. A variety of tabletting machinery is known, and can be used. Generally it will function by stamping a quantity of the particulate composition which is confined in a die.

In order to carry out the tabletting at a temperature which is above ambient, the particulate composition is preferably supplied to the tabletting machinery at an elevated temperature. This will of course supply heat to the tabletting machinery, but the machinery may be heated in some other way also.

For production scale machinery it may be desirable to construct the mould in which tabletting occurs so that it incorporates channels for the circulation of liquid at the desired temperature. Alternatively the mould could be surrounded by an electric heating coil, controlled by a temperature sensor in contact with the mould.

The temperature of the particulate composition delivered to the tabletting machinery may be regulated by conveying the composition through a tunnel which is heated to the temperature chosen for tabletting.

Preparation of the composition may itself generate heat and this may serve to bring the composition to the desired temperature for tabletting.

For any given starting composition, the compaction pressure which is used to form the tablets will affect both the strength of the tablets and the length of time for them to disintegrate when put into water. It is an advantage of this invention that raising the temperature of tabletting allows adequate strength to be achieved with lesser compaction pressures—which generally leads to more porous tablets which disintegrate more quickly and may also reduce the cost of the tabletting machinery.

A measure of the strength of tablets in their diametral fracture stress g calculated from the equation $$\sigma = \frac{2P}{\pi D t}$$

where $\sigma$ is the diametral fracture stress in Pascals, P is the applied load in Newtons to cause fracture, D is the tablet diameter in metres and t is the tablet thickness in metres.

Tablets of the invention preferably have a diametral fracture stress of at least 5 kPa, and more preferably at least 7 kPa.

The speed of disintegration of a detergent tablet can be assessed by means of the following test, referred to below as the "cage test".

The tablet is weighed, placed in a cage of perforated metal gauze (9 cm×4.5 cm×2 cm) having 16 apertures (each about 2.5 mm square) per $cm^2$. The cage is suspended in a beaker of demineralised water at 20° C. and rotated at 80 rpm. The time taken for the tablet to disintegrate and fall through the gauze (the disintegration time) is recorded (or after 10 minutes, if the tablet has not wholly disintegrated, the residue is determined by weighing after drying. The residue is quoted as a percentage of the original tablet weight.

It will be appreciated that this is a very stringent test, since water temperature and agitation are both much lower than in a real wash situation in a machine with a washload present. Disintegration times under real wash conditions are expected to be shorter.

EXAMPLE 1

A detergent base powder of the following composition was prepared.

| | |
|---|---|
| Coconut alkyl sulphate | 6.4% |
| Coconut alcohol (7EO) ethoxylate | 6.4% |
| Coconut alcohol (3EO) ethoxylate | 8.2% |
| Zeolite (reckoned as anhydrous) | 40.0% |
| Sodium carboxymethyl cellulose | 1.0% |
| Sodium carbonate | 1.25% |
| Soap | 2.25% |
| Water | 4.3% |
| Sodium disilicate | 3.7% |
| Sodium percarbonate | 16.8% |
| Bleach activator | 3.8% |
| Antifoam, fluorescer, perfume and other minor ingredients | balance to 100% |

The coconut alkyl sulphate, nonionic detergent and the zeolite were mixed together in a Fukae high speed mixer/granulator, after which the remaining ingredients were added in succession. The soap was formed in situ by neutralisation of fatty acid.

This base powder was sprayed with polyethylene glycol of average molecular weight 1500 (PEG 1500). This was sprayed at about 80° C. onto the base powder at 35° C., in a quantity which was 5% of the quantity of base powder, and thus 4.8% of the resulting mixture.

The PEG 1500 functions as a binder and, when the tablets are placed in water, functions as a disintegrant, as demonstrated in published EP-A-522766.

The coated powder was made into tablets by placing a weighed quantity of the powder in a cylindrical mould and compacting the contents of the mould with a cylindrical punch. The punch was driven into the mould by an Instron Universal Testing Machine which applied a controlled, and measured, force. The pressure applied by the punch could readily be calculated because the cross-sectional area of the punch was known.

For these experiments 50 g of powder was used to make each tablet. The cylindrical mould had a diameter of 4.5 cm and the cylindrical tablets produced generally had a thickness of approximately 2 cm.

To control the temperature of compaction, the powder was stored in a temperature controlled oven for a time before carrying out the compaction step.

Tablets were made at 22° C. and 40° C., using several levels of compaction pressure. The diametral fracture stress of the tablets was measured. As a comparison tablets which omitted the PEG 1500 binder were also made at 22° C. and tested. The results were as follows:

| Compaction | Diametral Fracture Stress (kPa) | | |
|---|---|---|---|
| | Compaction at 22° C. | | Compaction |
| Pressure $N.cm^{-2}$ | No PEG | 4.8% PEG 1500 | at 40° C. 4.8% PEG 1500 |
| 15.7 | 0 | 1.5 | 13.2 |
| 31.4 | 0.72 | 3.8 | 21.1 |
| 62.8 | 2.5 | 13.6 | 45.4 |
| 125.8 | 6.3 | 28.9 | 74.2 |

Tablets chosen from those above to have approximately equal strength, and including PEG 1500 binder, were tested for disintegration, using the cage test described above.

The results were:

| | Residue in Cage (%) | |
|---|---|---|
| Diametral Fracture Stress | Compaction at 22° C. | Compaction at 40° C. |
| 13.2 | | 0 |
| 13.6 | 20 | |
| 21.1 | | 22 |
| 28.9 | 56 | |

These results show that compaction at lower pressure but higher temperature can produce tablets of approximately equal strength which then disintegrate faster, thus leaving less residue.

EXAMPLE 2

A detergent powder with the following formulation was prepared in the same manner as in the previous example.

| | |
|---|---|
| Coconut alkyl sulphate | 1.6% |
| Coconut alcohol (6.5EO) ethoxylate | 5.8% |
| Coconut alcohol (3EO) ethoxylate | 8.7% |
| Zeolite (reckoned as anhydrous) | 35.3% |
| Sodium carboxymethyl cellulose | 1.2% |
| Soap | 3.8% |
| Water | 7.6% |
| Sodium perborate monohydrate | 19.5% |
| Tetraacetyl ethylene diamine | 4.2% |
| Sodium disilicate | 4.2% |
| Antifoam, fluorescer, and other minor ingredients | 3.8% |
| PEG 1500 | 4.3% |

Tablets were prepared from this powder as described in the previous example at various temperatures and with various levels of compaction pressure. The diametral fracture stress of the resulting tablets was measured and the results are set out in the following table.

| Compaction | | Diametral Fracture Stress (kPa) | | | |
|---|---|---|---|---|---|
| Force (KN) | Pressure ($N.cm^{-2}$) | 20° C. | 30° C. | 35° C. | 40° C. |
| 0.25 | 15.7 | 0 | 1.1 | 5.0 | 7.8 |
| 0.50 | 31.4 | 1.0 | 3.0 | 9.4 | 14.1 |
| 1.0 | 62.8 | 4.0 | 8.1 | 14.9 | 23.6 |
| 1.5 | 94.2 | 7.1 | | | |
| 2.0 | 125.6 | 10.2 | 16.7 | 26.2 | 34.8 |

Tablets of similar strength were tested for disintegration by the "cage test" described above. The results were:

| Compaction Conditions | Diametral Fracture Stress | % Residue |
|---|---|---|
| 94.2 $Ncm^{-2}$ at 20° C. | 7.1 kPa | 46.4% |
| 15.7 $Ncm^{-2}$ at 40° C. | 7.5 kPa | 12% |

EXAMPLE 3

A detergent powder, akin to those in the previous examples, was prepared and made into tablets as in Example 1. As in that example, tablets were prepared at 20° C. and 40° C. containing 4.3% PEG 1500. Tablets were also prepared at 20° C. without PEG 1500.

The tablets were tested for strength and speed of disintegration, as before. The results are given in the table below where "DFS" denotes Diametral Fracture Stress in kPa and "residue" denotes percentage residue in the cage test.

| Compaction | | 20° C. No PEG | | 20° C. | | 40° C. | |
|---|---|---|---|---|---|---|---|
| Force | Pressure | | Resi- | 4.3% PEG 1500 | | 4.3% PEG 1500 | |
| KN | $Ncm^{-2}$ | DFS | due | DFS | Residue | DFS | Residue |
| 0.25 | 15.7 | 0 | | 0.8 | | 6.0 | 0% |
| 0.5 | 31.4 | 0.2 | | 1.2 | 0% | 8.9 | 4% |
| 1.0 | 62.8 | 1.4 | 4% | 3.1 | 0% | 14.8 | 60% |
| 2.0 | 125.6 | 3.8 | 6% | | | | |
| 5.0 | 314 | 13.7 | 84% | | | | |

These results confirm that binder increases tablet strength and show that use of raised temperature for tabletting leads to a further increase in strength. Compared to tablets of similar or somewhat less strength made at 20° C. without binder, there is a reduction in the residue in the cage test.

EXAMPLE 4

The detergent powder used in Example 3 was also used to make tablets, at 50° C., containing 4.8% by weight of polyethylene glycol of average molecular weight 4000 (PEG 4000) which melts at approximately 55° C. Tablets without PEG, also made at 50° C., provided a comparison.

The tablets were tested for strength and speed of disintegration, as before. The results are given in the table below where "DFS" denotes Diametral Fracture Stress in kPa and "residue" denotes percentage residue in the cage test.

| Compaction | | | | | |
|---|---|---|---|---|---|
| Force | Pressure | No PEG | | 4.8% PEG 4000 | |
| KN | $Ncm^{-2}$ | DFS | Residue | DFS | Residue |
| 0.25 | 15.7 | 0 | | 20 | 0% |
| 0.5 | 31.4 | 0.2 | | 31 | 0% |
| 1.0 | 62.8 | 1.4 | | 48 | 70% |
| 2.0 | 125.6 | 3.8 | 0% | | |
| 5.0 | 314 | 13.7 | 30% | | |

These results show that PEG 4000 as binder, with a raised temperature for tabletting leads to a considerable increase in strength. Compared to tablets of less strength made without binder, there is a reduction in the residue in the cage test.

EXAMPLE 5

A number of tablets were prepared with each of the formulations set out in the following Table:

| | Composition No: | | | |
|---|---|---|---|---|
| | 1 | 2 | 3 | 4 |
| | % by weight | | | |
| Granulated Components | | | | |
| coconut primary alkyl sulphate | 4.8 | 1.4 | 1.3 | 1.4 |
| coconut alcohol 3EO | — | — | 7.1 | 6.85 |
| coconut alcohol 5EO | 11.0 | 12.4 | — | — |
| Coconut alcohol 7EO | — | — | 4.7 | 5.5 |
| zeolite A24 | 27.8 | 29.3 | 29.9 | 29.3 |
| soap | 1.7 | 2.9 | 3.0 | 2.9 |
| SCMC | 0.8 | 0.8 | 1.0 | 0.8 |
| Sodium carbonate | 1.0 | 0.3 | — | 0.6 |
| water | 5.3 | 5.3 | 5.2 | 5.3 |
| Postdosed Components | | | | |
| PEG 1500 | 4.3 | 4.3 | 4.3 | 4.3 |
| Coated sodium percarbonate | 19.5 | 19.5 | 19.5 | 19.5 |
| TAED granule | 4.2 | 4.2 | 4.2 | 4.2 |
| perfume | 0.6 | 0.6 | 0.6 | 0.6 |
| antifoam | 3.6 | 3.6 | 3.6 | 3.6 |
| sodium citrate | 15.0 | 15.0 | 15.0 | 15.0 |

The materials listed as "granulated components" were mixed in a Fukae (Trade Mark) FS-100 high speed mixer-granulator. The soap was prepared in situ by neutralisation of fatty acid.

In the case of compositions 1, 2 and 4 the primary alkyl sulphate, sodium carbonate, much of the water content and a small amount of zeolite were added as preformed granules. In the case of composition 3 the primary alkyl sulphate, nonionic detergent, fatty acid and sodium hydroxide to neutralise the fatty acid were all mixed together before addition to the mixer-granulator.

For all four compositions the mixture was granulated and densified to give a powder of bulk density greater than 750 g/litre and a mean particle size of approximately 650 μm.

The powder was sieved to remove fine particles smaller than 180 μm and large particles exceeding 1700 μm. The remaining solids were then mixed with the powder in a rotary mixer, after which the perfume was sprayed on, followed by the PEG. The PEG was sprayed at about 70° C. with the powder at about 35° C.

Detergent tablets were prepared at 40° C., as in Example 1 by compaction of the detergent powder formulations at various compaction pressures. The diametral fracture stresses were determined as described earlier.

The disintegration of the tablets in water was tested by the cage test given earlier. The results of these tests are set out below in three tables which show comparison between tablets of composition 1, with a 30:70 ratio of primary alkyl sulphate to nonionic detergent, and tablets of compositions 2, 3 and 4 with a 10:90 ratio.

As can be seen from these tables, tablets of compositions 2, 3 and 4 generally have less residue than tablets of composition 1, with the same or smaller value of DFS, thus indicating that compositions 2, 3 and 4 can provide tablets which are stronger but disintegrate faster than tablets of composition 1.

| composition | 1 | 2 | 1 | 2 | 1 | 2 | 1 | 2 |
|---|---|---|---|---|---|---|---|---|
| compaction force (kN) | 0.4 | 0.7 | 0.5 | 0.9 | 1 | 1.5 | 2.5 | 3 |
| density ($kg/m^3$) | 1200 | 1220 | 1240 | 1265 | 1295 | 1315 | 1385 | 1380 |
| DFS (kPa) | 5 | 6 | 7.5 | 9 | 12 | 13 | 16 | 21 |
| Residue (%) | 0 | 0 | 50 | 27 | 78 | 50 | 95 | 68 |
| composition | 1 | 3 | 1 | 3 | 1 | 3 | 1 | 3 |
| compaction force (kN) | 0.4 | 0.9 | 0.5 | 1.5 | 1 | 2.1 | 2.5 | 3.3 |
| density ($kg/m^3$) | 1200 | 1240 | 1240 | 1290 | 1295 | 1340 | 1385 | 1390 |
| DFS (kPa) | 5 | 7.5 | 7.5 | 10 | 12 | 15 | 16 | 19 |
| Residue (%) | 0 | 0 | 50 | 5 | 78 | 45 | 95 | 70 |
| composition | 4 | 1 | 4 | 1 | 4 | 1 | 4 | 1 |
| compaction force (kN) | 1.1 | 0.4 | 1.5 | 0.5 | 2 | 1 | 2.8 | 2.5 |
| density ($kg/m^3$) | 1245 | 1200 | 1285 | 1240 | 1340 | 1295 | 1395 | 1385 |
| DFS (kPa) | 4.5 | 5 | 7 | 7.5 | 0 | 12 | 15 | 16 |
| Residue (%) | 0 | 0 | 20 | 50 | 45 | 78 | 85 | 95 |

EXAMPLE 6

Further powder compositions were prepared using a similar procedure. Composition of these powders was:

| | Parts by weight |
|---|---|
| Granulated Components | |
| coconut primary alkyl sulphate | 1.33 |
| coconut alcohol 5EO | 11.94 |
| zeolite | 29.13 |
| soap | 3.12 |

-continued

| | Parts by weight |
|---|---|
| water | 5.0 |
| Postdosed Components | |
| PEG | 5.0 |
| Sodium carboxymethyl cellulose | 0.8 |
| sodium perborate tetrahydrate | 19.5 |
| TAED granule | 4.2 |
| antifoam | 3.4 |
| sodium citrate | 15.0 |
| perfume and other minor ingredients | 1.6 |

Three grades of polyethylene glycol were used. These were of molecular weights 1500, 4000 and 6000, melting at 40° C., 55° C. and 62° C. respectively.

The PEG was melted and sprayed onto the granular powder. The powder was then compacted into tablets. Operating at a temperature 5–10 degrees below the melting point of the PEG using various levels of compaction force. Some control tablets were made using powder without any PEG. This was compacted with a greater level of force A number of tablets were tested to determine Diametral Fracture Stress. The tablets, bulk density was calculated from the weight and dimensions of the tablets. The porosity of the tablets was calculated, knowing the true density of the detergent powder to be 1–62. The formula was $$\text{Porosity} = 1 - \frac{Dt}{1.62}$$

$$Dt = \text{bulk density} = \frac{\text{Tablet Weight}}{\text{Tablet Volume}}$$

Results are set out in the following table.

| PEG Molecular Weight | Tablet Porosity | DFS (kPa) |
|---|---|---|
| 0 | 0.3 | 5 |
| 0 | 0.2 | 18 |
| 1500 | 0.3 | 15 |
| 1500 | 0.2 | 60 |
| 4000 | 0.3 | 25 |
| 4000 | 0.2 | 70 |
| 6000 | 0.3 | 28 |
| 6000 | 0.2 | >80 |

It can be seen that the higher molecular weight PEG's and tabletting at high temperature, associated with the high melting point of the PEG, gave greater strength for the same porosity.

We claim:

1. In a process for making tablets of a detergent composition comprising from 2% to 50% by weight of one or more detergent active compounds, from 5% to 80% by weight of a detergency builder by the steps of:

spraying from 0.1% to 10% by weight of a polyethylene glycol binder which is a water-soluble organic polymer having a melting temperature in a range from 35° C. to 90° C., onto at least some of the particles of the detergent composition, introducing said particulate detergent composition into a mould, compacting said particulate detergent composition within the mould, the improvement which comprises compacting the particulate composition into tablets at a temperature which is at least 28° C. but is at least 5° C. below the melting temperature but not more than 15° C. below the melting temperature of the binder.

2. A process according to claim 1 wherein the melting temperature is in arrange from 35° C. to 70° C.

3. A process according to claim 1 wherein the detergent composition comprises 15% to 60% by weight of aluminosilicate detergency builder.

4. A process according to claim 3 wherein the detergent composition comprises at least 20% by weight of aluminosilicate detergency builder.

5. A process according to claim 1 wherein the binder is present in an amount from 3% to 6% by weight.

6. A process according to claim 1 wherein the composition contains at least 20% by weight of water-soluble compound other than said detergent-active/and binder.

7. A process according to claim 1 wherein said one or more detergent active compounds comprise nonionic detergent and non-soap anionic detergent.

8. A process according to claim 7 wherein the weight ratio of nonionic detergent to non-soap anionic detergent lies in the range 95:5 to 80:20.

* * * * *